US006928885B1

(12) United States Patent
Shiao et al.

(10) Patent No.: US 6,928,885 B1
(45) Date of Patent: Aug. 16, 2005

(54) TORQUE-INDICATING WRENCH

(76) Inventors: Hsuan-Sen Shiao, No. 55, Cheng Feng Lane, Tai Ming Road, Wu Jih Hsiang, Taichung Hsien (TW); Da-Jeng Yao, 2nd Fl., No. 25, Alley 11, Lane 76, Chung Cheng Road, Hsin Tien City, Taipei Hsien (TW)

( * ) Notice: Subject to any disclaimer, the term of this patent is extended or adjusted under 35 U.S.C. 154(b) by 0 days.

(21) Appl. No.: 10/989,445

(22) Filed: Nov. 16, 2004

(30) Foreign Application Priority Data

Aug. 23, 2004 (TW) ..... 93125345 A

(51) Int. Cl.[7] ..... B25B 23/14
(52) U.S. Cl. ..... 73/862.21; 73/862.191
(58) Field of Search ..... 73/862.191–862.26, 73/862

(56) References Cited

U.S. PATENT DOCUMENTS 3,943,761 A * 3/1976 Shoberg et al. ..... 73/862.474
4,006,629 A * 2/1977 Barrett et al. ..... 73/862.26
4,558,601 A * 12/1985 Stasiek et al. ..... 73/862.23

* cited by examiner

*Primary Examiner*—Edward Lefkowitz
*Assistant Examiner*—Alandra Ellington
(74) *Attorney, Agent, or Firm*—Ladas & Parry LLP

(57) ABSTRACT

A torque-indicating wrench comprises a wrench body including a head to engage and turn a workpiece, and a stem having two outer longitudinal wall segments. A strainable body made of a material with an elasticity modulus smaller than that of the stem has a gage carrying major wall which is disposed on the outer longitudinal wall segment such that the strainable body is stretchable relative thereto. A restraining member is disposed to restrain the strainable body from moving away from the outer longitudinal wall segment while permitting a stretching movement of the strainable body. A strain gage unit is attached to the gage carrying major wall to detect change in resistance values corresponding to stretching deformation of the strainable body for processing by a processing circuit so as to obtain a value of torque applied to the workpiece.

7 Claims, 10 Drawing Sheets

TORQUE-INDICATING WRENCH

CROSS-REFERENCE TO RELATED APPLICATION

This application claims priority of Taiwanese Application No. 093125345, filed on Aug. 23, 2004.

BACKGROUND OF THE INVENTION

1. Field of the Invention

This invention relates to a torque-indicating wrench, more particularly to an electrical torque-indicating wrench with a replaceable strain gage unit mounted to a wrench body for measuring a torque applied to a workpiece with a high degree of precision.

2. Description of the Related Art

U.S. Pat. Nos. 3,970,155, 4,006,629, 4,522,075, 4,669,319 and 4,976,133 disclose electrical torque-indicating wrenches that generally have strain gages attached to a lever arm proximate to a head for measuring torque. The head is suited to engage and rotate a workpiece by applying a force to the lever arm. The strain gages detect elastic strains and changes in electrical resistances, translate the changes into an electrical signal, and, in cooperation with a processing circuit which includes a Wheatstone bridge, an amplifier, a recorder, a microprocessor, an output unit, etc., determine a value of torque applied to the workpiece. Strain ($\epsilon$) is related to a bending moment (M) through the relationship:

$$\varepsilon = \frac{M * y}{E * I}$$

When an object with a modulus of elasticity (E) and a moment of inertia (I) relative to a neutral axis is subjected to a bending moment (M), the strain ($\epsilon$) is directly proportional to a distance (y) between the measured point and the neutral axis. In the aforementioned prior art wrenches, the strain gages are attached to a lateral surface of the lever arm away from the neutral axis so as to produce a larger strain value, based upon which the processing circuit can calculate the torque precisely. However, a relatively large area of the lateral surface of the lever arm to which the strain gages are attached has to be machined with high precision so as to facilitate attachment of the strain gages, thereby resulting in higher manufacturing cost. Furthermore, conventional strain gages are not replaceable once they are broken or damaged.

Referring to FIGS. 1 and 2, a conventional electrical torque-indicating wrench is shown to include a wrench body 1 having a head 102 and a handle 101 extending from the head 102. The handle 101 and the head 102 respectively have first and second mounting slots 1011, 1021 for receiving a strain detecting unit 2 and a display unit 3. The strain detecting unit 2 has a substrate 201 with a profile the same as that of the first mounting slot 1011. The substrate 201 has a recess 2011 for receiving a strain gage 202. When a torque producing force is applied to the handle 101, stretching deformation of the strain gage 202 results in a change in electrical resistance, which is detected and translated into an electrical signal. The strain detecting unit 2 can be replaced once the strain gage 202 is broken. However, since the profile of the substrate 201 has to be same as that of the first mounting slot 1011, the strain gage 202 is placed in close proximity to the neutral axis (X), thereby reducing the distance (y). Therefore, the strain ($\epsilon$) in the strain gage 202 is relatively small so that the change in electrical resistance is too small to permit precise torque measurement. Furthermore, although a signal output corresponding to the change in resistance can be amplified by amplifiers, the errors in the signal will be amplified at the same time so that a precise torque value cannot be obtained.

SUMMARY OF THE INVENTION

The object of the present invention is to provide a torque-indicating wrench which has a replaceable strain gage unit mounted to a wrench body for measuring a torque applied to a workpiece with a high degree of precision.

According to this invention, the torque-indicating wrench includes a wrench body having a head adapted to engage and turn a workpiece about a rotational axis, and a stem extending from the head in a longitudinal direction radial to the rotational axis to terminate at a coupled end. The stem is made from a material with a first modulus of elasticity, and has two outer longitudinal wall segments respectively extending in the longitudinal direction. A handle is coupled with the coupled end and is operable to turn the head.

At least one strainable body is made from a material with a second modulus of elasticity that is smaller than the first modulus of elasticity, and has a gage carrying major wall which is disposed on a respective one of the outer longitudinal wall segments so as to place the strainable body in a position of use where the strainable body is subject to stretching in the longitudinal direction in response to turning movement of the handle about the rotational axis. The gage carrying major wall has inner and outer major surfaces that are opposite to each other and that are respectively disposed proximate to and distal from the respective one of the outer longitudinal wall segments. The inner major surface, in the position of use, is brought into engagement with and is stretchable relative to the respective one of the outer longitudinal wall segments in the longitudinal direction.

A restraining member is disposed to restrain the strainable body from moving away from the respective one of the outer longitudinal wall segments in a transverse direction transverse to the longitudinal direction and the rotational axis while permitting a stretching movement of the strainable body in the longitudinal direction.

A strain gage unit is attached to the outer major surface to detect change in resistance values which is a function of extent of stretching deformation of the strainable body as a result of application of torque by the head when the head turns the workpiece about the rotational axis, and to translate the change in resistance values into an electrical signal.

A processing circuit is connected electrically to the strain gage unit to calculate a value of the torque applied to the workpiece in accordance with the electrical signal from the strain gage unit so as to generate an output signal.

A display unit is connected electrically to the processing circuit for receiving the output signal from the processing circuit and for translating the output signal into a visual presentation.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
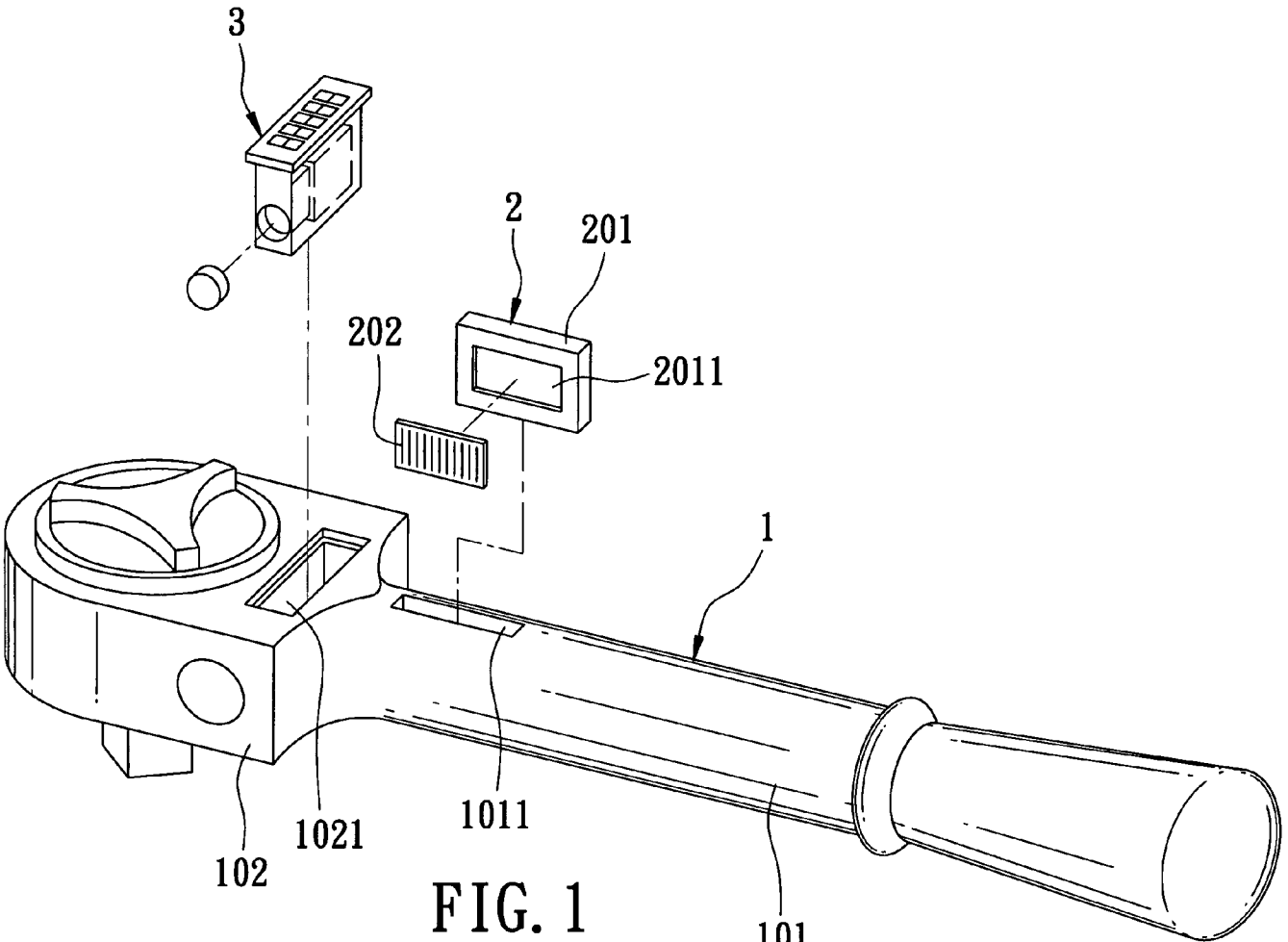
FIG. 1 PRIOR ART
FIG. 1 is an exploded perspective view of a conventional electrical torque-indicating wrench.

Before the present invention is described in greater detail, it should be noted that same reference numerals have been used to denote like elements throughout the specification.

Figure 3:
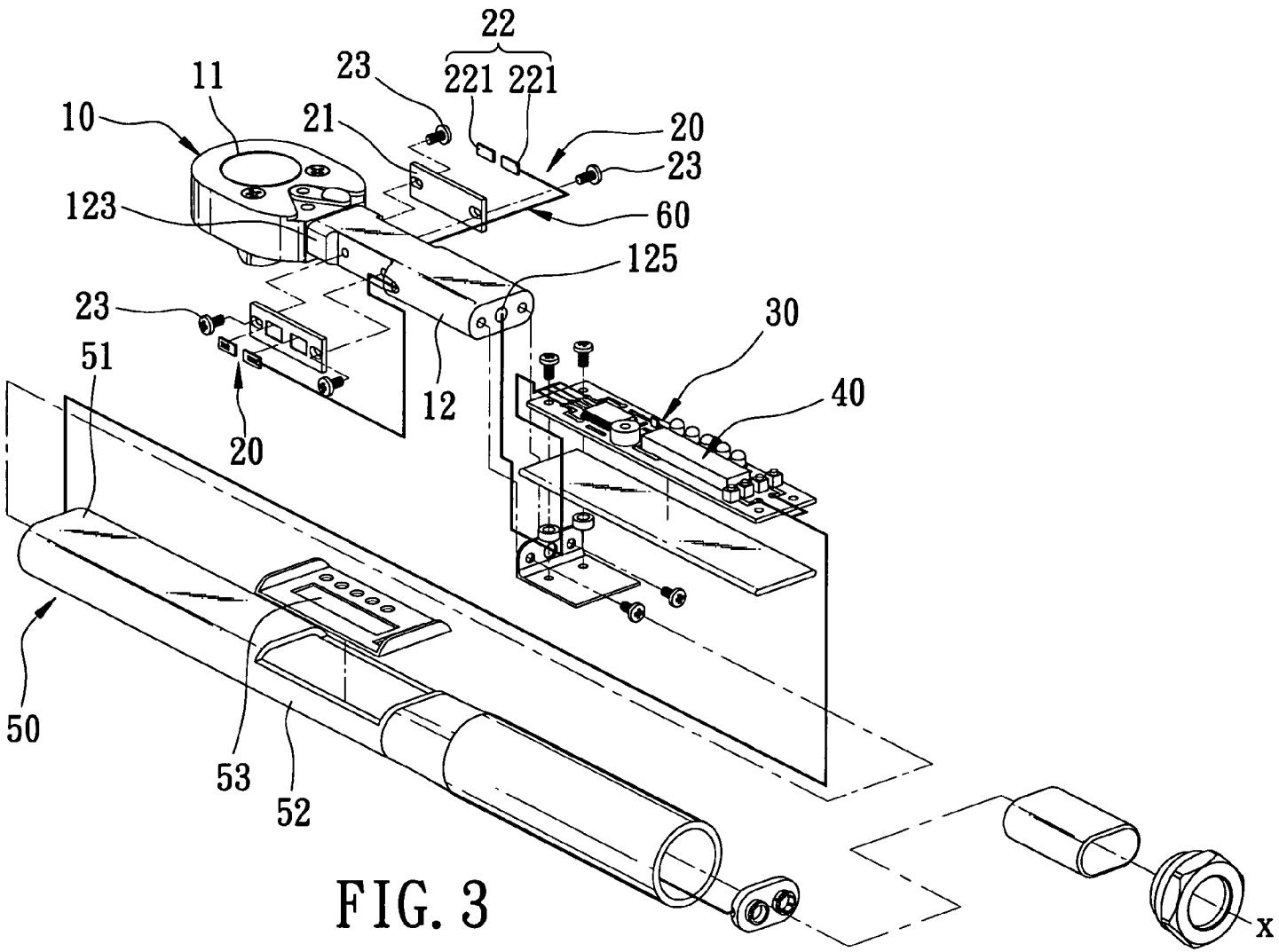
FIG. 3 is an exploded perspective view of the first preferred embodiment of a torque-indicating wrench according to this invention.
Figure 4:
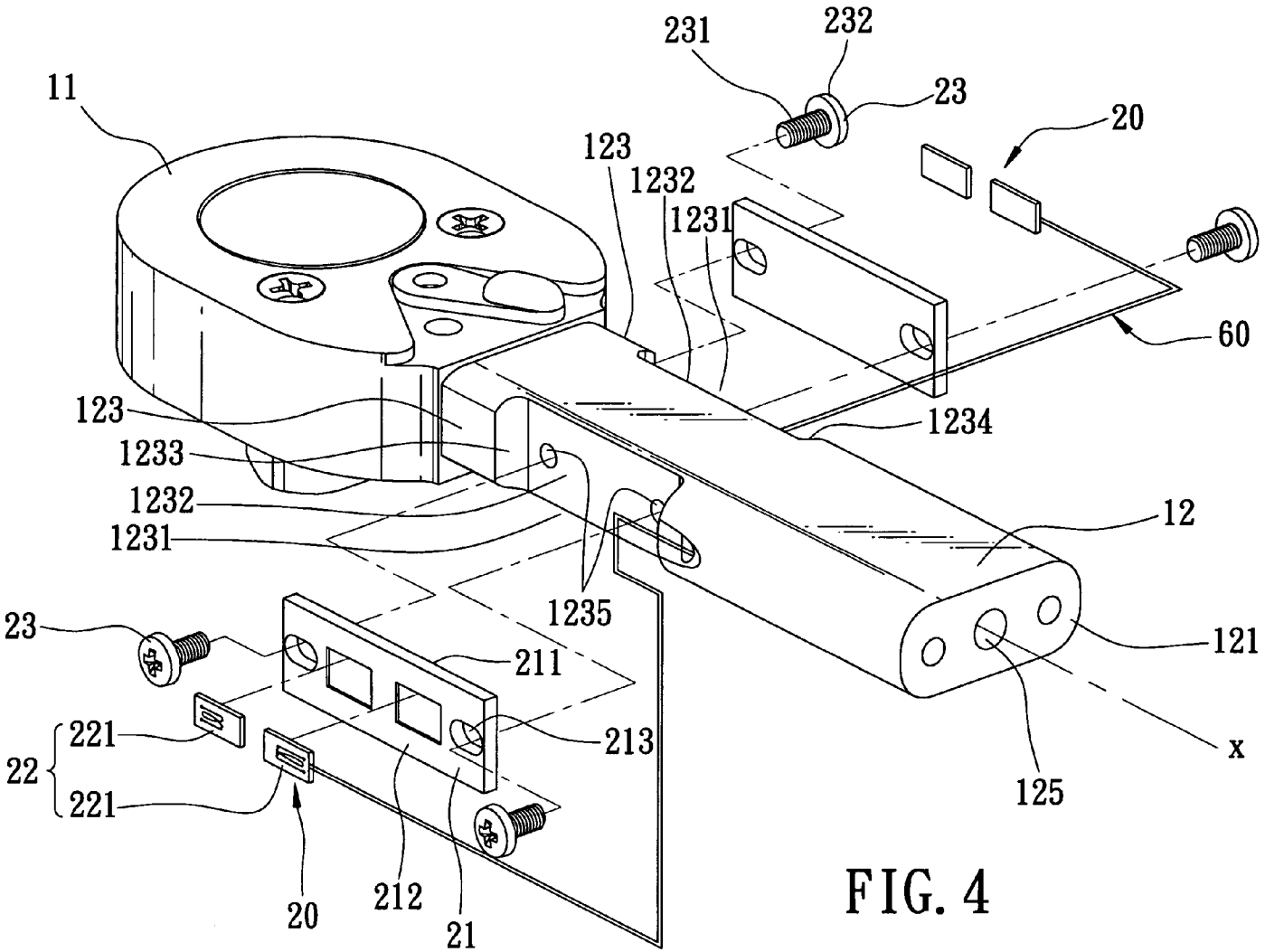
FIG. 4 is an exploded perspective view of a wrench body and a strain detecting unit of the first preferred embodiment.
Figure 5:
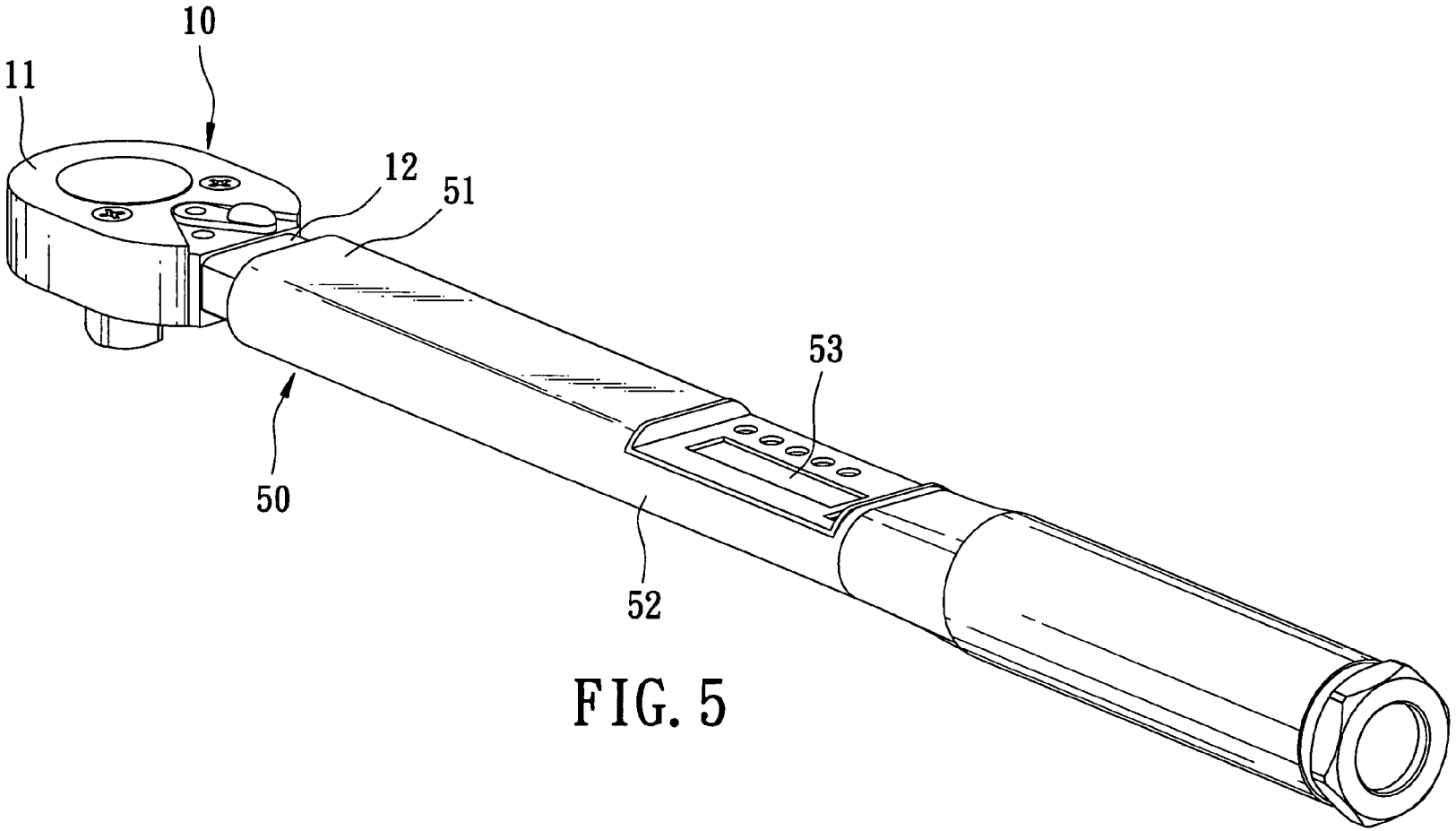
FIG. 5 is a perspective view of the first preferred embodiment.

Referring to FIGS. 3 to 5, the first preferred embodiment of a torque-indicating wrench according to the present invention is shown to comprise a wrench body 10, a handle 50, two strain detecting units 20, a processing circuit 30, and a display unit 40.

The wrench body 10 has a head 11 which is adapted to engage and turn a workpiece (not shown) about a rotational axis, and a stem 12 which extends from the head 11 in a longitudinal direction radial to the rotational axis, and which terminates at a coupled end 121. The stem 12 is made from a material with a first modulus of elasticity (E1), such as steel with E1=190 Gpa, and has two outer longitudinal wall segments 123 which are opposite to each other relative to a neutral axis (x) of the stem 12 and which respectively extend in the longitudinal direction. Each of the outer longitudinal wall segments 123 is recessed in a transverse direction transverse to the longitudinal direction and the rotational axis to form a concavity 1231, and has front and rear edge portions 1233, 1234 opposite to each other in the longitudinal direction, and a bottom portion 1232 interconnecting the front and rear edge portions 1233, 1234 to define the concavity 1231. The coupled end 121 defines a wire receiving hole 125 which extends to be communicated with the concavities 1231 formed in the outer longitudinal wall segments 123.

The handle 50 is tubular, and has a front portion 51 which defines a forwardly opened recess that extends in the longitudinal direction and that is configured for insertion of the stem 12 in the longitudinal direction so as to be operable to turn the head 11 about the rotational axis, and a rear portion 52 which is opposite to the front portion 51 and which has a display opening 53.

Each of the strain detecting units 20 is detachably mounted in a respective one of the concavities 1231, and includes a strainable body 21, a restraining member and a strain gage unit 22.

The strainable body 21 is made from a material with a second modulus of elasticity (E2) that is smaller than the first modulus of elasticity (E1), such as aluminum alloy with E2=70 Gpa, and has a gage carrying major wall which is disposed on the respective outer longitudinal wall segment 123 so as to place the strainable body 21 in a position of use where the strainable body 21 is subject to stretching in the longitudinal direction in response to turning movement of the handle 50 about the rotational axis. Specifically, the gage carrying major wall has inner and outer major surfaces 211, 212 which are opposite to each other and which are respectively proximate to and distal from the respective outer longitudinal wall segment 123. The inner major surface 211, in the position of use, is attached to and is stretchable relative to the bottom portion 1232 of the respective outer longitudinal wall segment 123 in the longitudinal direction, and is spaced apart from the front and rear edge portions 1233, 1234, as shown in FIG. 7.

The restraining member includes two screw holes 1235 which are formed in the bottom portion 1232 of the respective outer longitudinal wall segment 123 and which are opposite to each other in the longitudinal direction, two elongated holes 213 which extend from the outer major surface 212 through the inner major surface 211 and which are elongated in the longitudinal direction, and two screw bolts 23. Each of the screw bolts 23 has a screw shank 231 that extends through a respective one of the elongated holes 213 and that threadedly engages a respective one of the screw hole 1235 which is registered therewith, and an enlarged head 232 that abuts against the outer major surface 212 around the respective elongated hole 213 so as to restrain the strainable body 21 from moving away from the bottom portion 1232 in the transverse direction and so as to permit the stretching movement of the strainable body 21 in the longitudinal direction.

Figure 7:
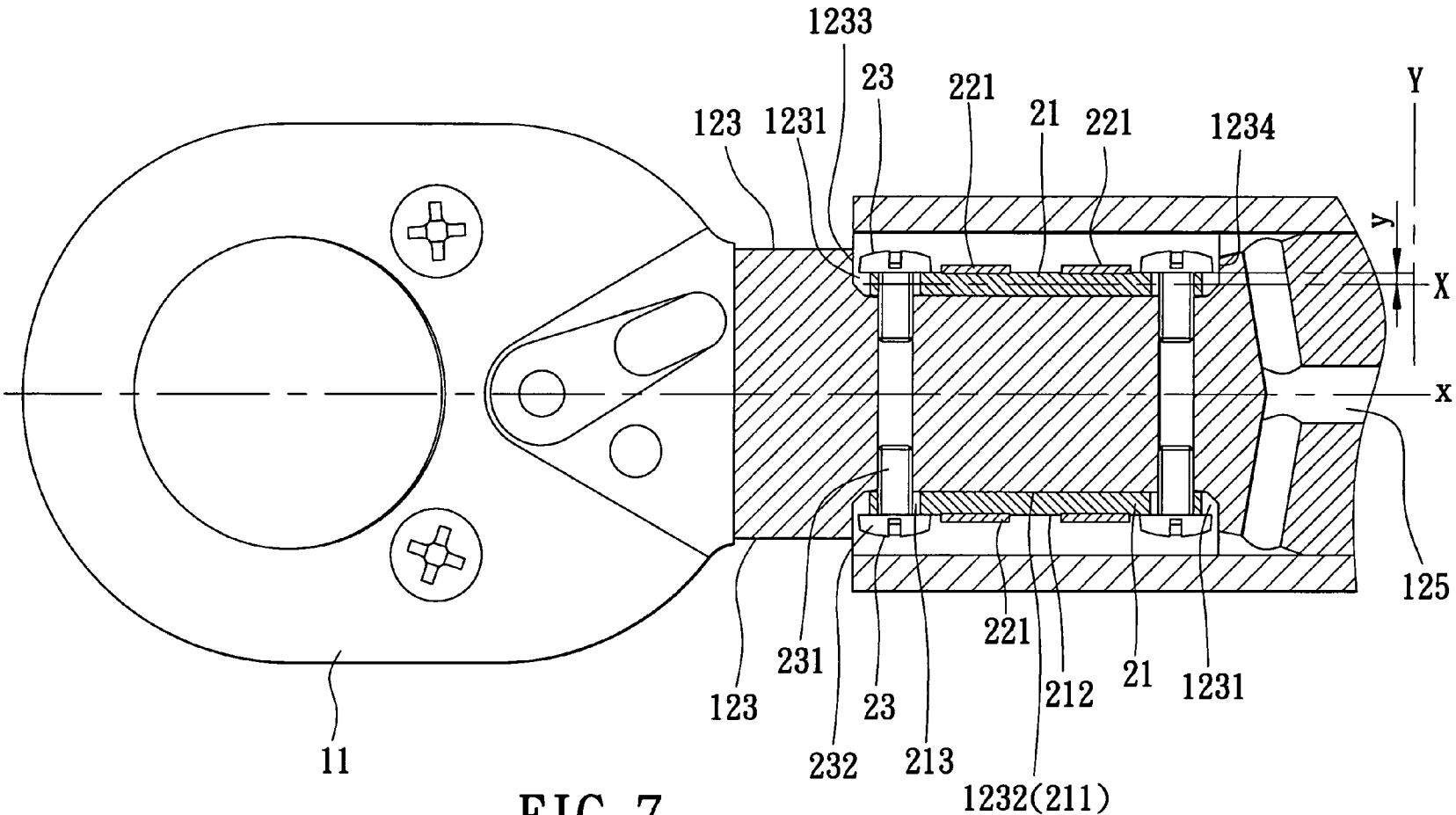
FIG. 7 is an encircled portion in FIG. 6.

The strain gage unit 22 includes two strain gages 221 which are attached to the outer major surface 212 of the respective strainable body 21 between the elongated holes 213, which are spaced apart from the front portion 51 of the handle 50 in the transverse direction, and which are spaced apart from each other in the longitudinal direction, as shown in FIG. 7. Each of the strain gages 221 detects a change in resistance values, which is a function of extent of stretching deformation of the strainable body 21 as a result of application of torque by the head 11 when the head 11 turns the workpiece about the rotational axis, and translates the change in resistance values into an electrical signal.

Figure 6:
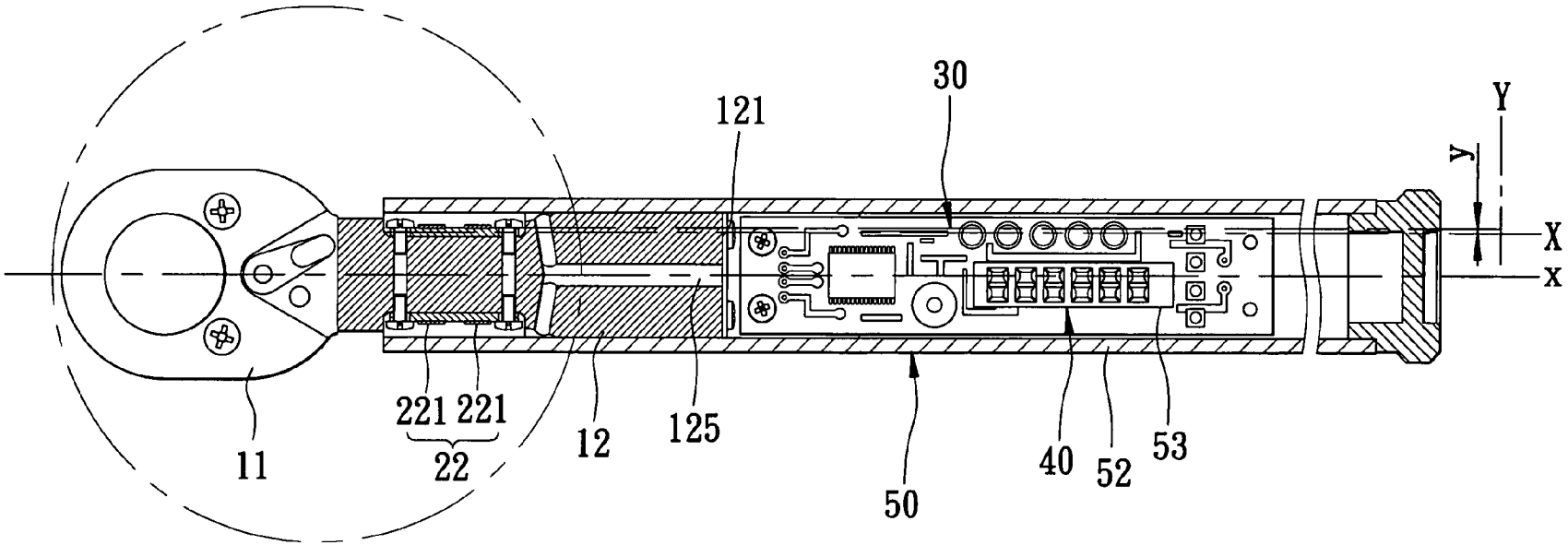
FIG. 6 is a sectional view of the first preferred embodiment.

With reference to FIGS. 3 and 6, the processing circuit 30 is mounted on the stem 12, and is connected electrically to the strain gages 221 by electric wires 60 that extend through the wire receiving hole 125. The processing circuit 30 calculates a value of the torque applied to the workpiece in accordance with the electrical signal from the strain gage units 22 so as to generate an output signal.

The display unit 40 is received in the rear portion 52 of the handle 50, and is connected electrically to the processing circuit 30 for receiving the output signal from the processing circuit 30 and for translating the output signal into a visual presentation for viewing through the display opening 53. As the processing circuit 30 and the display unit 40 are known in the art, a detailed description thereof is dispensed with herein for the sake of brevity.

Figure 2:
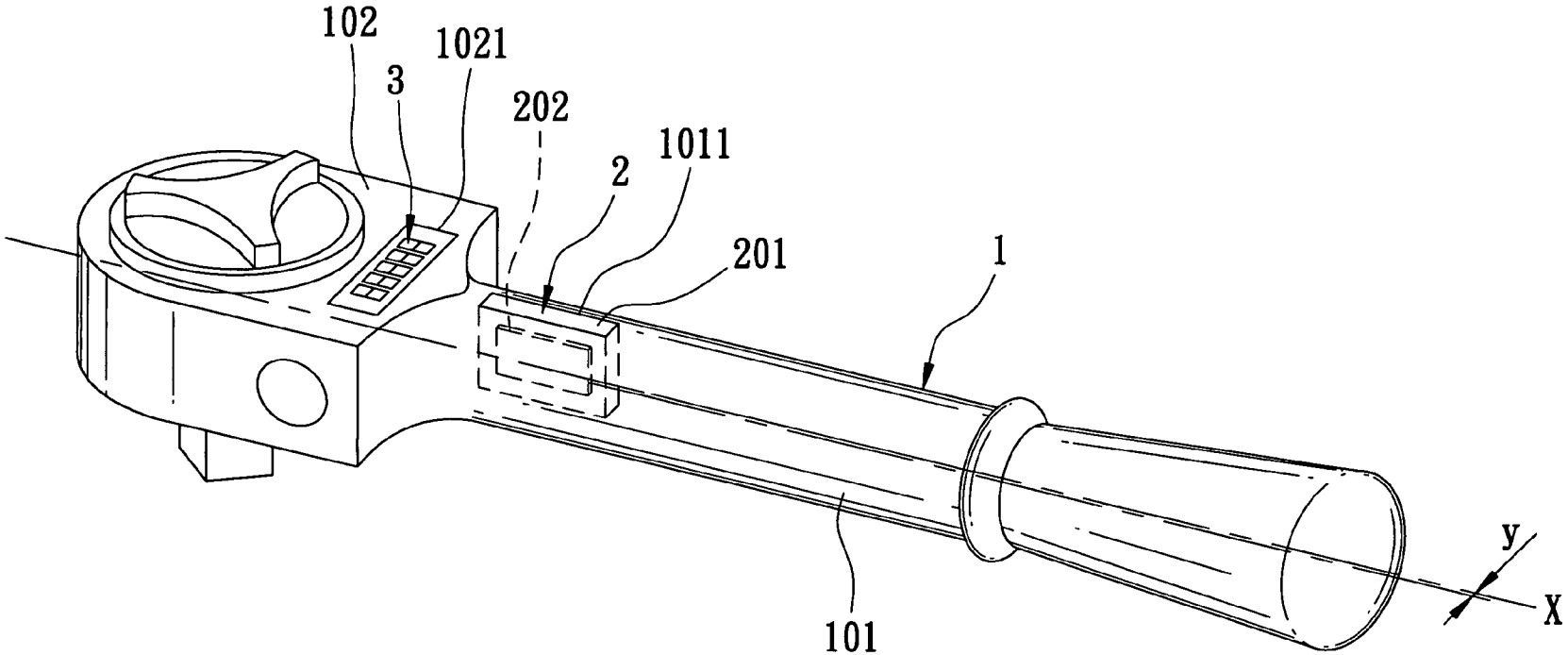
FIG. 2 PRIOR ART
FIG. 2 is a perspective view of the conventional electrical torque-indicating wrench.

Referring to FIGS. 6 and 7, when a torque is applied to the head 11 to turn a workpiece about the rotational axis, the torque producing force is transmitted to the strainable bodies 21 by virtue of engagement of the bottom portions 1232 of the outer longitudinal wall segments 123 with the inner major surfaces 211 of the strainable bodies 21 so as to result in stretching deformation of the strainable bodies 21. Due to the presence of the elongated holes 213 and clearances between the strainable bodies 21 and the front and rear edge portions 1233, 1234, deformational displacement of the strainable bodies 21 is not interfered by the outer longitudinal wall segments 123 of the stem 12 so that a precise torque measurement can be obtained. Moreover, since the strain gages 221 are attached to the strainable bodies 21, the strain detecting units 20 can be detached from the concavities 1231 for replacement once the strain gages 221 are broken. In addition, as compared with the aforesaid conventional electric torque-indicating wrench shown in FIGS. 1 and 2, the machining process of the strainable bodies 21 are easier, and can achieve a higher degree of precision, thereby reducing the manufacturing cost.

According to the aforesaid relationship between the strain ($\epsilon$) and the bending moment (M), since the strain gages 221 are attached to the strainable body 21 in this embodiment, the distance (y) from the strain gages 221 to a neutral line (X) of the respective strainable body 21 can be made greater as compared with the aforesaid conventional wrench. In addition, since the second modulus of elasticity (E2) of the strainable body 21 is smaller than the first modulus of elasticity (E1) of the stem 12, and since the strainable body 21 has a moment of inertia (I) that is smaller than that of the handle 101 of the aforesaid conventional wrench, the strain ($\epsilon$) generated in the strain gages 221 of this embodiment is greater as compared with the aforesaid conventional wrench, thereby producing a significant change in resistance values for processing by the processing circuit 30 to obtain a precise torque value.

Figure 8:
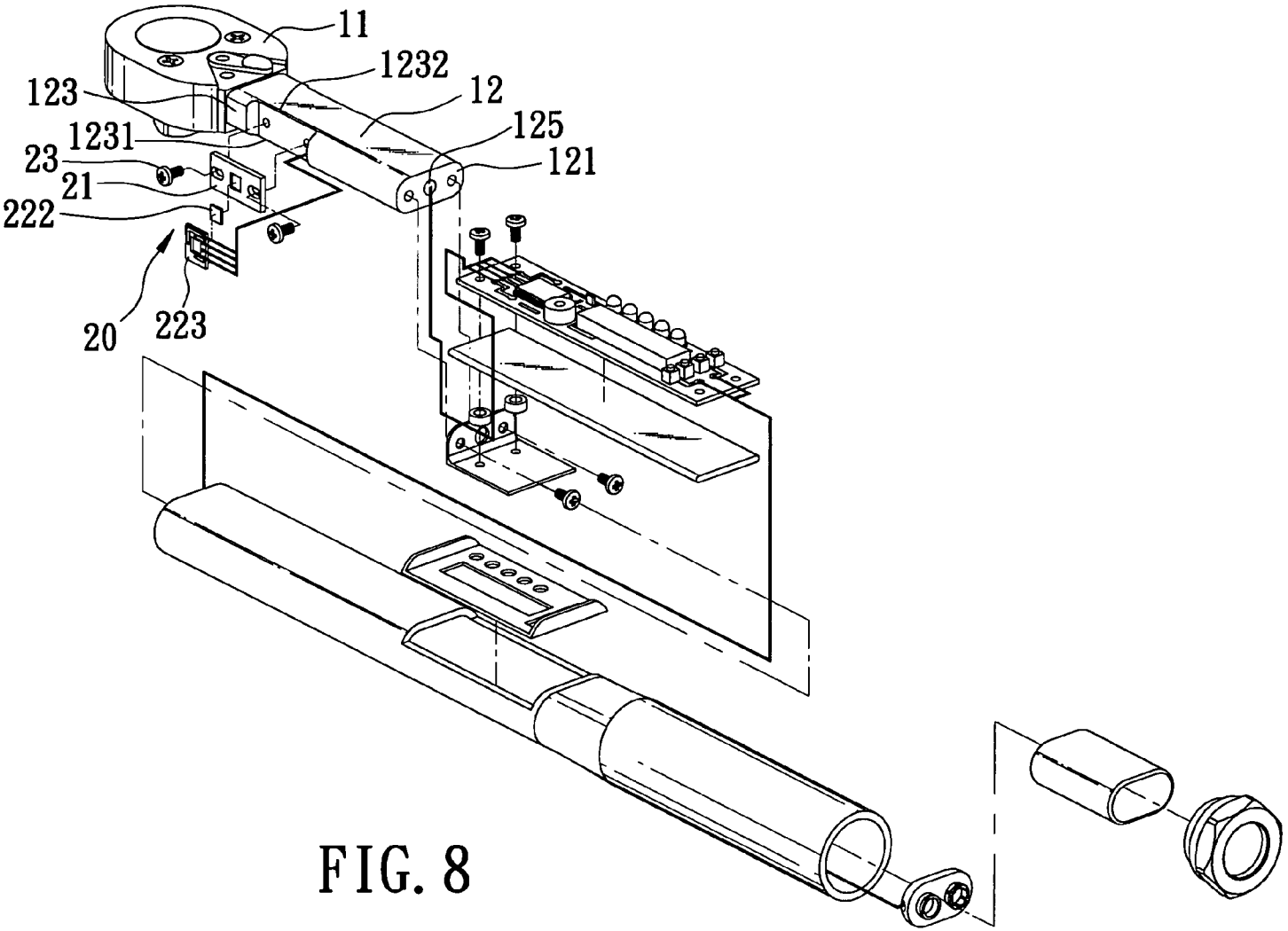
FIG. 8 is an exploded perspective view of the second preferred embodiment of a torque-indicating wrench according to this invention.
Figure 9:
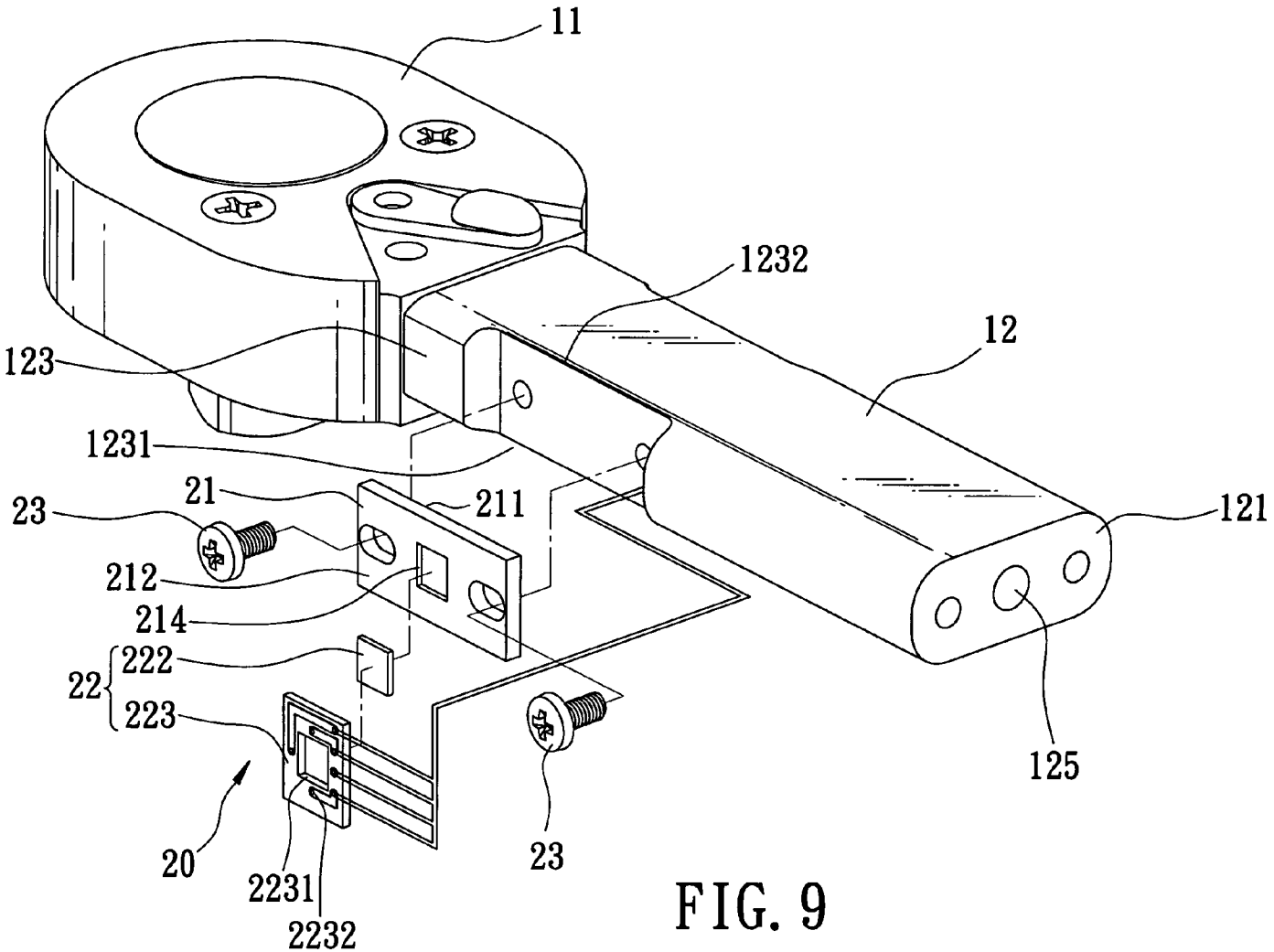
FIG. 9 is an exploded perspective view of a wrench body and a strain detecting unit of the second preferred embodiment.
Figure 10:
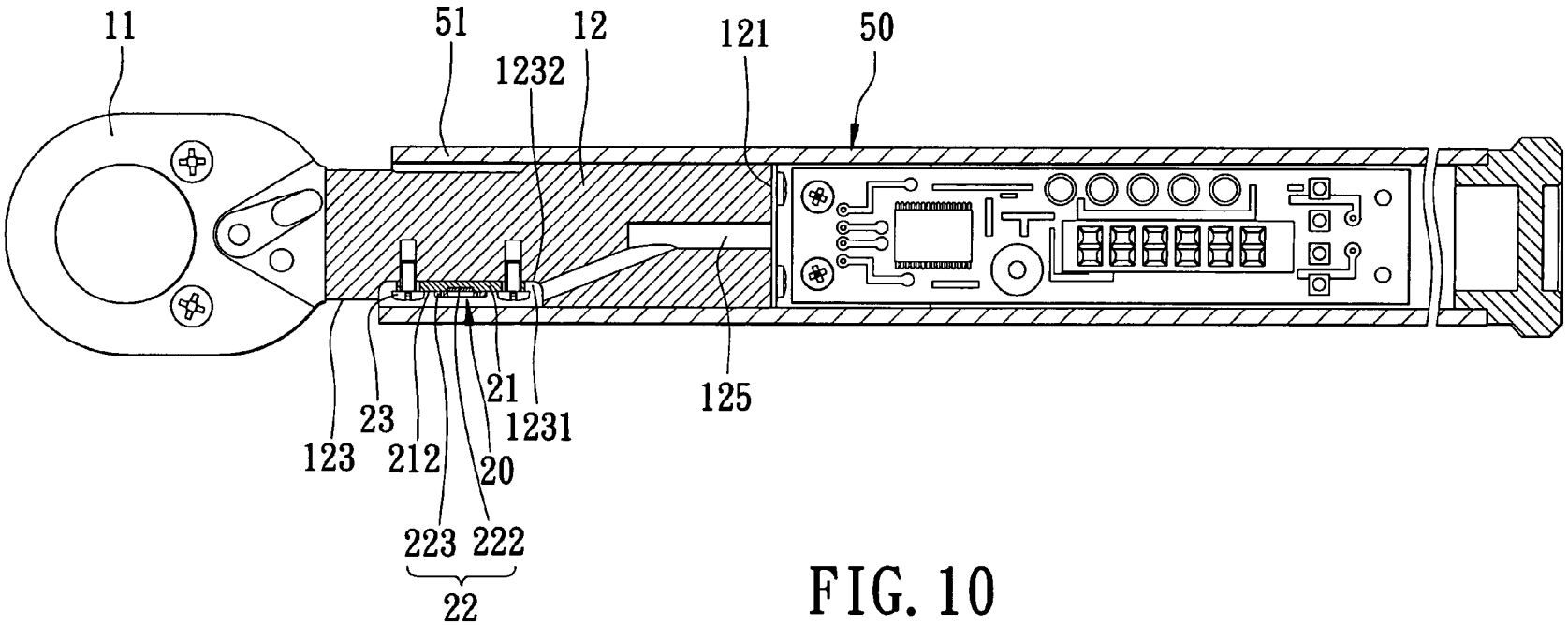
FIG. 10 is a sectional view of the second preferred embodiment.

As shown in FIGS. 8 to 10, the second preferred embodiment of a torque-indicating wrench according to this invention is shown to be similar to that of the first preferred embodiment in construction, function and effect. The outer major surface 212 of the strainable body 21 of the strain detecting unit 20 has a receiving groove 214 which is recessed towards the inner major surface 211. The strain gage unit 22 includes a plurality of strain gages that are integrated into a chipset 222 which is received in the receiving groove 214, and a packaging substrate 223 which is mounted on the outer major surface 212 and which is spaced apart from the front portion 51 of the handle 50. The packaging substrate 223 has a plurality of electrical contacts 2232 and an opening 2231 which is registered with the chipset 222 such that the electrical contacts 2232 are electrically connected to the chipset 222.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A torque-indicating wrench comprising:

a wrench body having a head which is adapted to engage and turn a workpiece about a rotational axis, and a stem which extends from said head in a longitudinal direction radial to the rotational axis, and which terminates at a coupled end, said stem being made from a material with a first modulus of elasticity, and having two outer longitudinal wall segments which are opposite to each other relative to a neutral axis of said stem and which respectively extend in the longitudinal direction;

a handle disposed to couple with said coupled end and operable to turn said head about the rotational axis;

at least one strainable body, which is made from a material with a second modulus of elasticity that is smaller than the first modulus of elasticity, and which has a gage carrying major wall that is disposed on a respective one of said outer longitudinal wall segments so as to place said strainable body in a position of use where said strainable body is subject to stretching in the longitudinal direction in response to turning movement of said handle about the rotational axis, said gage carrying major wall having inner and outer major surfaces that are opposite to each other and that are respectively disposed proximate to and distal from the respective one of said outer longitudinal wall segments, said inner major surface, in the position of use, being brought into engagement with and being stretchable relative to the respective one of said outer longitudinal wall segments in the longitudinal direction;

a restraining member disposed to restrain said strainable body from moving away from the respective one of said outer longitudinal wall segments in a transverse direction transverse to the longitudinal direction and the rotational axis while permitting a stretching movement of said strainable body in the longitudinal direction;

a strain gage unit attached to said outer major surface to detect change in resistance values which is a function of extent of stretching deformation of said strainable body as a result of application of torque by said head when said head turns the workpiece about the rotational axis, and to translate the change in resistance values into an electrical signal;

a processing circuit connected electrically to said strain gage unit, and calculating a value of the torque applied to the workpiece in accordance with the electrical signal from said strain gage unit so as to generate an output signal; and a display unit connected electrically to said processing circuit for receiving the output signal from said processing circuit and translating the output signal into a visual presentation.

2. The torque-indicating wrench of claim 1, wherein each of said outer longitudinal wall segments is recessed in the transverse direction to form a concavity, and has front and rear edge portions opposite to each other in the longitudinal direction, and a bottom portion interconnecting said front and rear edge portions to define said concavity, said inner major surface of said strainable body being attached to said bottom portion, and being spaced apart from said front and rear edge portions.

3. The torque-indicating wrench of claim 2, wherein said restraining member includes two screw holes which are formed in said bottom portion of a respective one of said outer longitudinal wall segments and which are opposite to each other in the longitudinal direction, two elongated holes which extend from said outer major surface through said inner major surface, which are elongated in the longitudinal direction, and which are opposite to each other relative to said strain gage unit, and two screw bolts, each of which has a screw shank that extends through a respective one of said elongated holes and that threadedly engages a registered one of said screw holes, and an enlarged head that abuts against said outer major surface around the respective one of said elongated holes so as to restrain said strainable body from moving away from said bottom portion and so as to permit the stretching movement of said strainable body in the longitudinal direction.

4. The torque-indicating wrench of claim 2, wherein said handle is tubular, and has a front portion which defines a forwardly opened recess that extends in the longitudinal direction and that is configured such that said strain gage unit is spaced apart from said front portion in the transverse direction, and a rear portion which is opposite to said front portion for receiving said processing circuit and said display unit, and which has a display opening for displaying the visual presentation.

5. The torque-indicating wrench of claim 4, wherein said coupled end defines a wire receiving hole which extends to be communicated with said concavity.

6. The torque-indicating wrench of claim 2, wherein said at least one strainable body includes two strainable bodies which are respectively disposed on said outer longitudinal wall segments, said strain gage unit including two pairs of strain gages which are attached to said outer major surfaces of said strainable bodies, respectively, said strain gages of each of said pairs being spaced apart from each other in the longitudinal direction.

7. The torque-indicating wrench of claim 2, wherein said outer major surface of said strainable body has a receiving groove which is recessed towards said inner major surface, said strain gage unit including a plurality of strain gages that are integrated into a chipset which is received in said receiving groove, and a packaging substrate which is mounted on said outer major surface and which is spaced apart from said front portion of said handle, said packaging substrate having a plurality of electrical contacts and an opening which is registered with said chipset such that said electrical contacts are electrically connected to said chipset.

* * * * *